United States Patent [19]

Negishi

[11] Patent Number: 4,897,025

[45] Date of Patent: Jan. 30, 1990

[54] GEROTOR PUMP WITH EXTENDED INLET PORT

[76] Inventor: Ushiji Negishi, 934-2, Komagatacho, Maebashi-shi, Gunma, Japan

[21] Appl. No.: 228,244

[22] Filed: Aug. 4, 1988

[30] Foreign Application Priority Data

Aug. 6, 1987 [JP] Japan ..... 62-197753

[51] Int. Cl.[4] ..... F04C 2/10

[52] U.S. Cl. ..... 418/171; 418/189

[58] Field of Search ..... 418/171, 166, 168, 169, 418/170, 189

[56] References Cited

U.S. PATENT DOCUMENTS

| | | | |
|---|---|---|---|
| 3,242,867 | 3/1966 | Mosbacher | 418/171 X |
| 3,834,842 | 9/1974 | Dorff et al. | 418/189 X |
| 3,995,978 | 12/1976 | Khan et al. | 418/171 |
| 4,645,430 | 2/1987 | Carleton | 418/171 X |

FOREIGN PATENT DOCUMENTS

| | | | |
|---|---|---|---|
| 60-156988 | 8/1985 | Japan . | |
| 61-43288 | 3/1986 | Japan | 418/171 |

*Primary Examiner*—John J. Vrablik

*Attorney, Agent, or Firm*—Rodman & Rodman

[57] ABSTRACT

The trochoid pump includes an outer gear rotor and an inner gear rotor, which are different in number of teeth from each other, pressure chambers defined by adjoining teeth of both rotors and an end plate. The pressure chamber volumes are increased or decreased in accordance with rotations of both rotors. An intake opening communicates with the pressure chambers whose volumes are gradually increasing, out of the pressure chamber and an outlet opening communicates with the pressure chambers whose volumes are gradually decreasing. A starting end of the intake opening starts to be opened at a minimum gap position or a neighborhood position thereof. The starting end of the intake opening can be opened at a position advanced through a rotary angle of 4 degrees in the rotating direction of both rotors from the minimum gap position.

5 Claims, 5 Drawing Sheets

θ= + 12°
0.05kg/cm²
PRESSURE

θ= +4°
0.03kg/cm²
PRESSURE

θ= 0°
0.03kg/cm²
PRESSURE

θ= -4°
0.05kg/cm²
PRESSURE

θ= -8°
0.06kg/cm²
PRESSURE
TIME

GEROTOR PUMP WITH EXTENDED INLET PORT

BACKGROUND OF THE INVENTION

. Field of the Invention

The present invention relates to trochoid pumps, and more particularly, to noise control measures for them, and concerned with an effective one for use as a fuel pump for an automotive vehicle, for example.

2. Related Art Statement

As a trochoid pump for use as a fuel pump for an automotive vehicle, in Japanese Patent Laid-Open No. 60-156988, there has been described one comprising: an outer gear rotor and an inner gear rotor which are different in number of teeth from each other; pressure chambers defined by the distances of teeth of both rotors and an end plate, whose volumes are increased or decreased in accordance with rotations of both rotors; an intake opening communicated with the pressure chambers whose volumes are gradually increasing; and an outlet opening communicated with the pressure chambers whose volumes are gradually decreasing; wherein, in accordance with the rotations of both rotors, fuel is taken into the respective pressure chambers through the intake opening and fed under pressure through the outlet opening.

However, in the conventional trochoid pump of the type described, even in a minimum gap position between the teeth of both rotors, i.e. a so-called dead portion (a volume portion not contributing to the discharge), pressure from the discharge side is transmitted through a tip clearance between both rotors, whereby positive pressure is resulted, so that a large change in chamber pressure occurs when both rotors are turned from the dead portion to the intake side, thus resulting in occurrence of noises.

SUMMARY OF THE INVENTION

An object of the present invention is to provide a trochoid pump wherein noises occurring in dead portion can be controlled.

To achieve the above-described object, in the trochoid pump according to the present invention, a starting end of the intake opening starts from a minimum gap portion between the teeth of both rotors, or is in the vicinity of the minimum gap portion. The starting end of the intake opening of the trochoid pump can be provided at a position advanced through a rotary angle of 4 degrees in the rotating direction of both rotors from the minimum gap position. In the above-described trochoid pump, the minimum gap portion formed by the outer gear rotor and the inner gear rotor is in a state of being communicated with the intake opening or in a state close thereto, so that the pressure is not closed in. With this arrangement, a change in pressure at the time of turning from the discharge side to the intake side is controlled to be small, so that noises can be reduced.

BRIEF DESCRIPTION OF THE DRAWINGS

The above and other objects and features of the present invention will become more apparent when referred to the following descriptions given in conjunction with the accompanying drawings, wherein like reference numerals denote like elements, and in which.

DETAILED DESCRIPTION OF THE PREFERRED EMBODIMENTS

Figure 1:
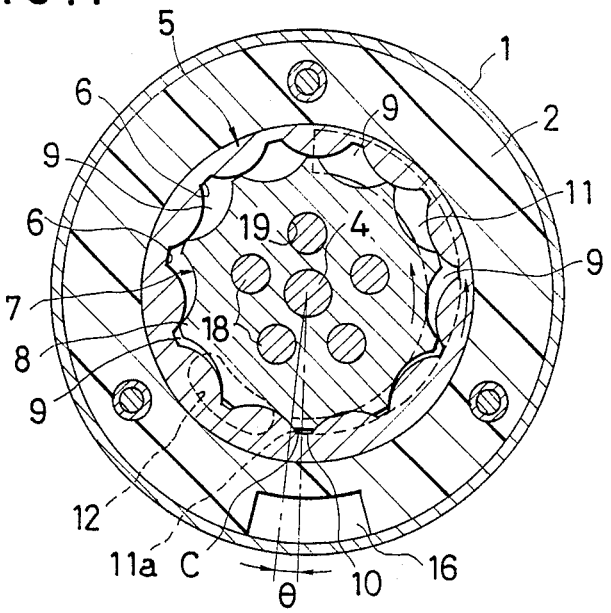
FIG. 1 is a front sectional view showing a first embodiment of the trochoid pump according to the present invention.
Figure 2:
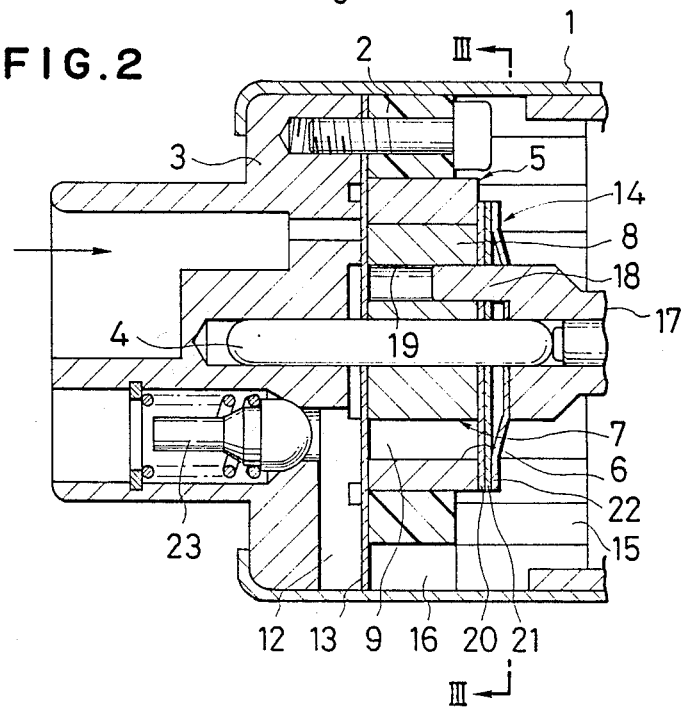
FIG. 2 is a side sectional view thereof.
Figure 3:
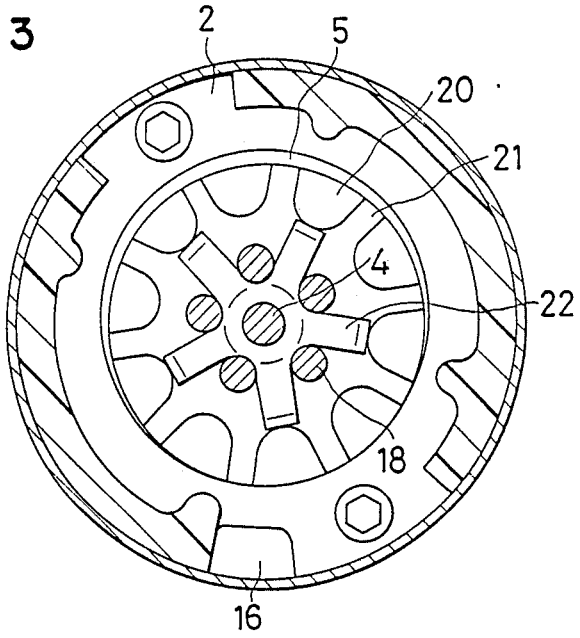
FIG. 3 is a front sectional view taken along the line III—III in FIG. 2.

Referring to the drawings, one embodiment of the present invention is shown in FIGS. 1–3. The trochoid pump according to this embodiment has a housing 1. Incorporated in the housing 1 in such a manner as to substantially constitute a pump casing are a cam ring 2, and an end plate 3 and a biasing means to be described hereunder, the latter two members being adapted to clamp this cam ring 2 in cooperation. Coupled into the cam ring 2 is an outer gear rotor 5 slidable in the circumferential direction and supported to be rotatable concentrically therewith. Formed on an inner peripheral surface of this outer gear rotor 5 are a plurality (11 in this embodiment) of recessed portions 6 in the shape of trochoid teeth. An inner gear rotor 7 is supported to be rotatable by a pivot shaft 4 and to be in predetermined relationship with the outer gear rotor 5. The inner gear rotor 7 is rotatably driven by a motor, not shown, through a drive dog 17 to be described hereunder. Formed on an outer peripheral surface of the inner gear rotor 7 are a plurality (10 in this embodiment) of raised portions 8 in the shapes of trochoid teeth. The recessed portions 6 of the outer gear rotor 5 and the raised portions 8 of the inner gear rotor 7 form pressure chambers 9 in cooperation, whereby, in accordance with rotations of both rotors, changes in volumes of the pressure chambers are caused, so that a pumping action to be described hereunder can be effected. Furthermore, at a dead portion 10, the recessed portions 6 of the outer gear rotor 5 and the raised portions 8 of the inner gear rotor 7 are brought into meshing engagement with each other.

A wear plate 13 is clamped between the end plate 3 and end faces of both rotors 5 and 7. Penetratingly provided through the end plate 3 and the wear plate 13 are an intake opening 11 and an outlet opening 12, which are provided at positions before and behind in the rotating direction of both rotors 5 and 7, bordering on the dead portion 10. The intake opening 11 and the outlet opening 12 have a circularly arcuate shape and a generally elliplical shape, respectively. The intake opening 11 communicates with the pressure chambers 9 whose volumes are gradually increasing, and the outlet opening 12 communicates with the pressure chambers 9 whose volumes are gradually decreasing and which are located near the dead portion 10.

Further, in this embodiment, a starting end 11*a* of the intake opening 11 is opened at a position close to the outlet opening 12, overlapping the dead portion 10. More specifically, the starting end 11*a* of the intake opening 11 is retarded through a rotary angle $\theta$ of 4 degrees in the counter-rotational direction from the dead portion 10. Provided at the side opposite to the end plate 3 of both rotors 5 and 7 is a biasing means 14 which prevents the outlet pressure from thrusting back to a pump cavity when cavitations occur in the pressure chamber 9.

More specifically, formed at the side opposite to the end plate 3 of both rotors 5 and 7 is a discharge chamber 15 opened into the housing 1. This discharge chamber 15 is communicated with an outside portion to be supplied through a discharge port, not shown. Furthermore, communicated with this discharge chamber 15 is the outlet opening 12 through a communication path 16. In the discharge chamber 15, the drive dog 17 driven by a rotary shaft of the motor is provided on the axial line of the pivot shaft 4. The pivot shaft 4 is rotatably coupled into the drive dog 17. A plurality of raised portions 18 are projectingly provided on the drive dog 17 and the raised portions 18 are coupled into recessed portions 19 of the inner gear rotor 7 around the pivot shaft 4, so that a rotary driving force can be transmitted.

The biasing means 14 includes a Gerotor seal 20, a seal support 21 and a Gerotor retainer 22, which are successively provided and clamped between end faces of both rotors 5 and 7 and the drive dog 17. The Gerotor seal 20 is in pressing contact with the end faces of both rotors 5 and 7 via the seal support 21 through a resilient force of the Gerotor retainer 22 formed of a sheet spring material. The Gerotor seal 20 is formed into a generally disk shape having a suitable flexibility from a fluoro resin sheet containing glass fibers, and is in pressing contact with the end faces of both rotors 5 and 7 via the Gerotor retainer 22 and the seal support 21, to thereby close the pressure chambers 9.

Referring to FIG. 3, the seal support 21 is provided thereon with a plurality of projecting pieces corresponding in number to that (10 in this embodiment) of the teeth of the inner gear rotor 7, and the respective projecting pieces project to the outer gear rotor 5 from positions between the teeth of the inner gear rotor 7. Furthermore, portions between the adjoining projecting pieces of the seal support 21 are cut away in generally semicircular shapes. The Gerotor retainer 22 has leg pieces corresponding in number to the half of the number of teeth of the inner gear rotor 7. The leg pieces extend radially through between the raised portions 18 of the drive dog 17 and adapted to press the Gerotor seal 20 and the seal support 21.

Designated at 23 in the drawing is a relief valve.

Action of this embodiment will hereunder be described.

When the inner gear rotor 7 is rotatably driven by the drive dog 17 in a direction indicated by an arrow in FIG. 1, the outer gear rotor 5 is caused to rotate in the same direction as the inner gear rotor 7 does. Along with the rotations of both rotors 5 and 7, the pressure chambers 9 formed by the trochoid teeth of both rotors are increased or decreased in the volumes thereof. Due to the increase in the volumes of the pressure chambers 9, fuel as being a working fluid is taken into the pressure chambers 9 whose volumes increase, through the intake opening 11, and, along with the decrease in volumes of the pressure chambers 9, the fuel is fed under pressure to the discharge chamber 15 against the resilient force of the Gerotor retainer 22 to flex the rotor seal 20.

When the pressure chambers 9 are decreased in the volumes thereof (i.e. when cross section areas of the chambers are decreased, as the lengths of both rotors 5 and 7 in axial direction, of course, being not varied), the fuel cannot act against the resilient force of the Gerotor retainer, and, in this case, the remaining portion of fuel is fed under pressure through the outlet opening 12.

Figure 4:
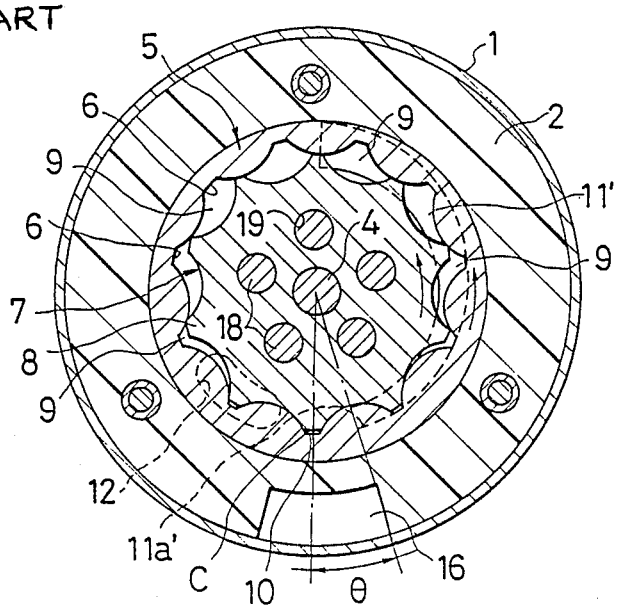
FIG.4 PRIOR ART
FIG. 4 is a front sectional view showing comparative examples in explanation of the actions thereof.

Now, as shown in FIG. 4, in a case of a conventional example where a starting end 11*a*′ of an intake opening 11′ is located at a position advanced more than the rotary angle $\theta$ of 4 degrees from the dead portion 10 in the rotating direction of both rotors, pressure of the discharge side is transmitted to the dead portion 10 through a tip clearance C, whereby positive pressure is resulted. Thus, due to the fact that pressure sharply fluctuates when both rotors 5 and 7 move from the dead portion 10 to the intake side, the vibrations of both rotors 5 and 7 are increased considerably, thus resulting in occurrence of noises.

In contrast thereto, in this embodiment, the starting end 11*a* of the intake opening 11 is opened at the retracted position closer to the outlet opening 12 than the dead portion 10 through the predetermined rotary angle (4 degrees), so that noises at the dead portion can be prevented from occurring.

More specifically, the recessed portions 6 of the outer gear rotor 5 and the raised portion 8 of the inner gear rotor 7 are in meshing engagement with each other at the dead portion 10, so that, inherently, pressure should not be introduced in the dead portion 10. However, for the purpose of securing the smooth rotations of both rotors 5 and 7, the tip clearance C is set, so that the pressure on the side of the outlet opening 12 is kept therein in closed state.

In this embodiment, however, the starting end 11*a* of the intake opening 11 has been opened through the tip clearance C, the pressure is not closed in and discharged through the intake opening 11. With this arrangement, the changes in pressure at the time the meshing portions between the recessed portions 6 and the raised portions 8 of both rotors 5 and 7 pass through the dead portion 10 are controlled to be small, so that vibrations of both rotors are reduced. As a result, the noises in the trochoid pump can be decreased to a considerable extent.

Figure 5:
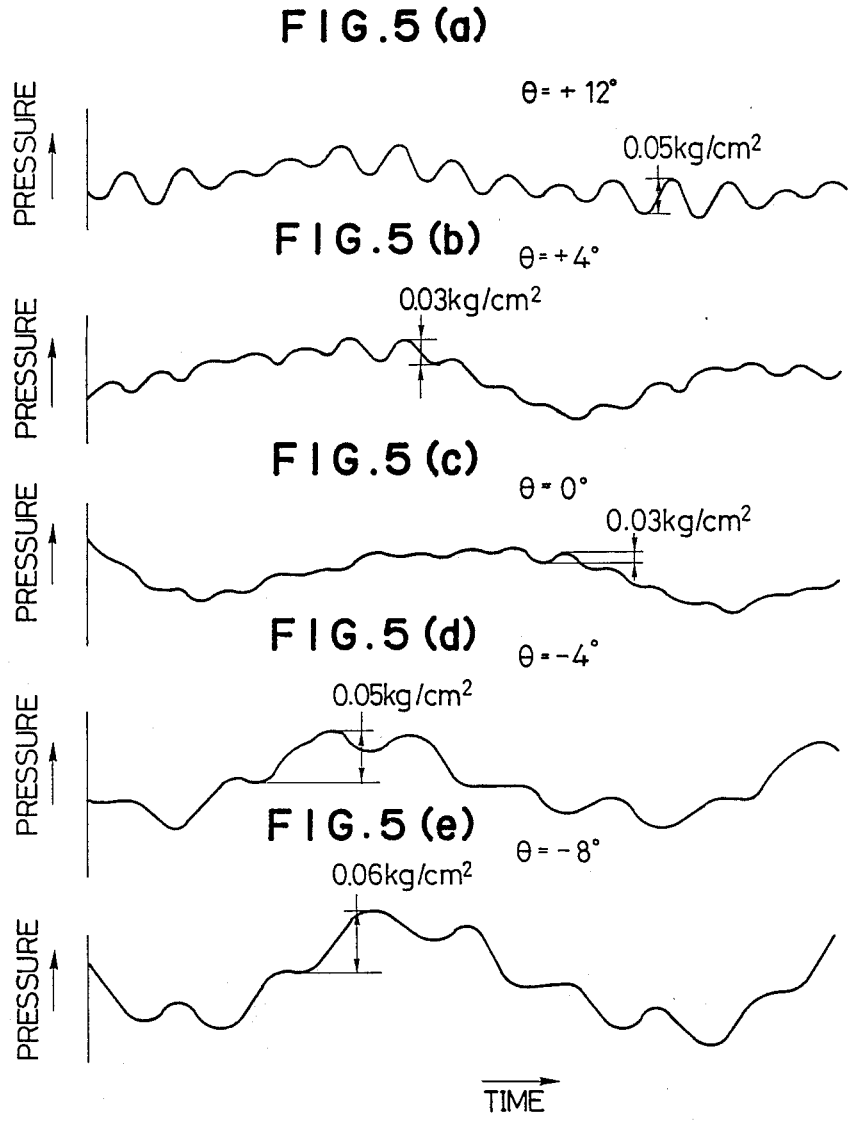
FIG. 5 (*a*), 5(*b*), 5(*c*), 5(*d*), 5(*e*)

FIGS. 5(*a*) to 5(*e*) are charts showing the noise reduction effects of the trochoid pump according to the present invention by way of the ripple wave shapes.

Among FIGS. 5(*a*) to 5(*e*), FIG. 5(*a*) is the chart of ripple wave shapes by the conventional example described in FIG. 4, wherein the starting end 11*a*′ of the intake opening 11′ is disposed at a position advanced through a rotary angle of 12 degrees in the rotating direction of both rotors from the dead portion 10.

FIGS. 5(*b*) and 5(*c*) are the charts by the third and second embodiments which are to be described hereunder. FIG. 5(*d*) is the chart by this first embodiment. Furthermore, FIG. 5(*e*) is the chart in a case where the starting end of the intake opening is disposed at a position retracted through a rotary angle of 8 degrees in the counter-rotational direction of both rotors from the dead portion.

According to these FIGS. 5, in the case of this first embodiment (FIG. 5(*d*)), it is clearly understood that the small wave shapes are removed as compared with the case of the conventional example (FIG. 5(*a*)).

Figure 6:
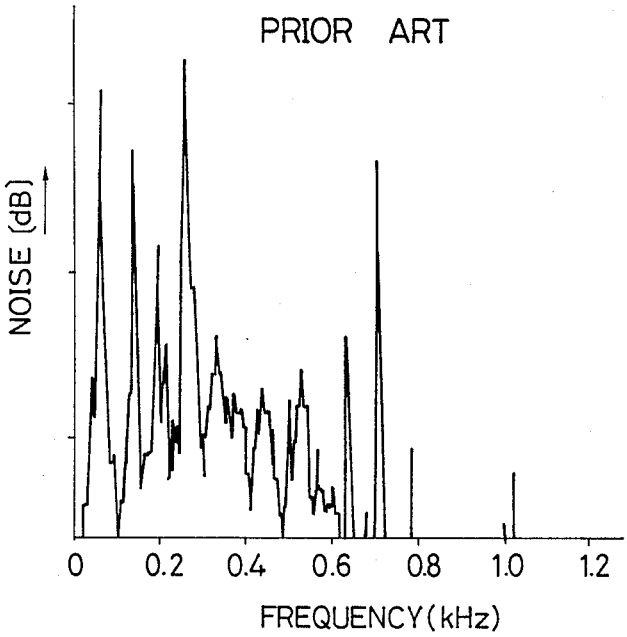
FIG.6 PRIOR ART
FIG. 6 and FIG. 7 are charts in explanation of effects thereof.
Figure 7:
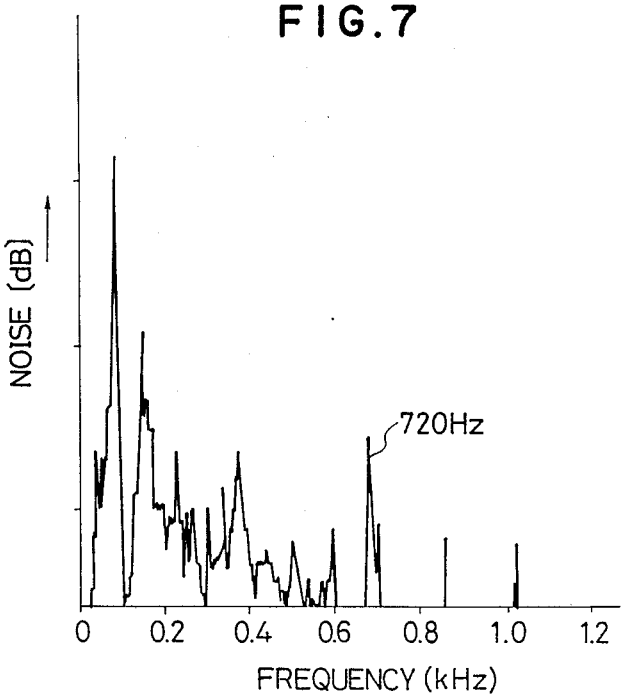

FIGS. 6 and 7 are the charts showing the frequency bands where the noises are controlled in the trochoid pump according to this embodiment. FIG. 6 shows the conventional example, while, FIG. 7 shows this embodiment.

From the comparison between FIGS. 6 and 7, it is understood that, in this embodiment, the noises at the frequency of 720 Hz are reduced the most. The noises around this frequency are most offensive to the ear, so that reduction of these noises is most effective for the noise control.

In general, in the trochoid pump, a product of the frequency occurring from the rotational number multiplied by a number of times of discharge per rotation from the pressure chambers formed by both rotors (10 in a case where 10 teeth and 11 teeth are combined together) becomes a critical frequency. In the case of the experiments in which the data shown in FIGS. 5 to 7 are obtained, the rotational numbers were 4000 to 4500 rpm and the frequencies were 67–75 Hz×10=670–750 Hz. From FIGS. 5 to 7, it is known that the pulsation caused by the changes in pressure during one rotation of the rotor is reduced, so that the noises are reduced.

Figure 8:
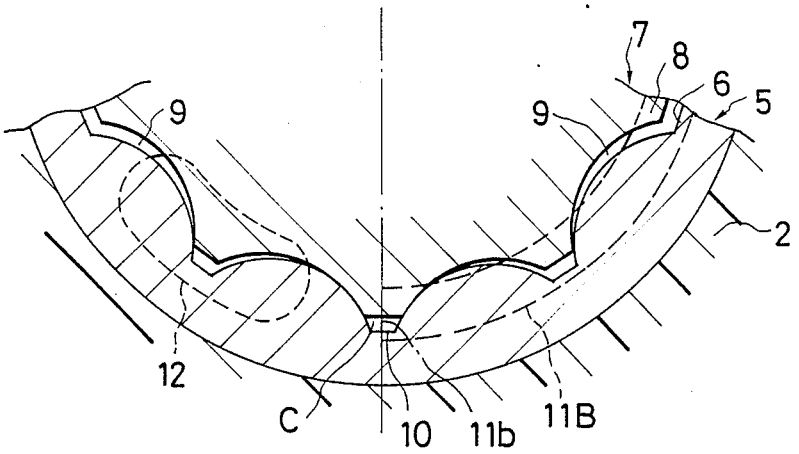
FIG. 8 is a front sectional view with an enlarged portion, showing a second embodiment of the present invention.

FIG. 8 is the front sectional view with an enlarged portion, showing the second embodiment of the present invention.

A difference of the second embodiment from the first one resides in that a starting end 11*b* of an intake opening 11B is disposed at a position meeting with the dead portion 10.

FIG. 5(*c*) is the chart of ripple wave shapes by the second embodiment. From this drawing, it is understood that both the small wave shapes and large wave shapes are flattened. Consequently, according to the second embodiment, the noise control effect becomes more remarkable.

Figure 9:
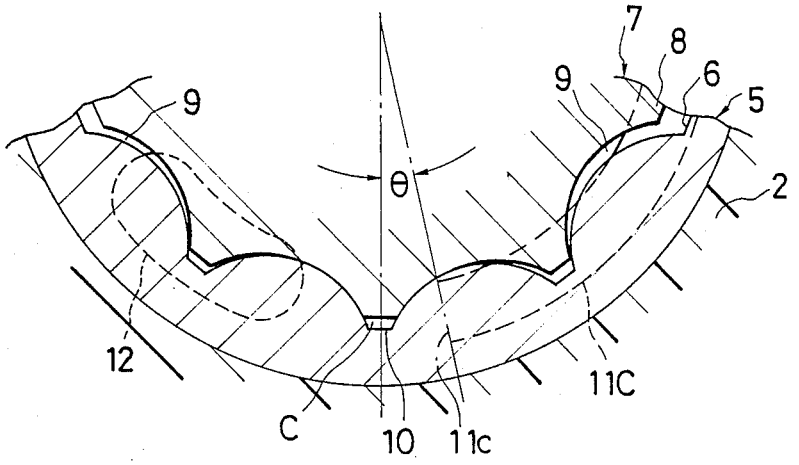
FIG. 9 is a front sectional view with an enlarged portion, showing a third embodiment of the present invention.

FIG. 9 is the front sectional view with an enlarged portion, showing the third embodiment of the present invention.

A difference of the third embodiment from the above-described embodiments resides in that a starting end 11*c* of an intake opening 11C is disposed at a position advanced through a rotary angle of 4 degrees in the rotating direction of both rotors from the dead portion 10.

FIG. 5(*b*) is the chart of ripple wave shapes according to the third embodiment. From this drawing, it is understood that small wave shapes are flattened as compared with the case of the conventional example. Consequently, according to the third embodiment, the noises are reduced as compared with the conventional example.

Incidentally, the present invention should not necessarily be limited to the above-described embodiments, and needless to say that various modifications can be adopted within the range not departing from the gist.

For example, the numbers of teeth of the outer gear rotor and inner gear rotor and the like should not necessarily be limited to those shown in the above-described embodiments.

As has been described hereinabove, according to the present invention, the noises from the trochoid pump can be reduced at low costs without increasing the number of parts and impairing the assembling workability.

What is claimed is:

1. A trochoid pump comprising, an outer gear rotor having a first predetermined number of teeth and an inner gear rotor having a second predetermined number of teeth different in number from the first predetermined number of teeth, the inner gear rotor teeth being in contact with the outer gear rotor teeth, such that pressure chambers are defined by adjoining teeth of said outer and inner gear rotors, said pressure chambers having corresponding volumes that gradually increase and gradually decrease respective predetermined amounts in accordance with rotations of said outer and inner gear rotors in a predetermined direction, an intake opening communicating with selected ones of said pressure chambers having volumes that gradually increase during rotation of said outer and inner gear rotors in said predetermined direction, and an outlet opening communicating with a second selected amount of said pressure chambers having corresponding volumes that gradually decrease during rotation of said outer and inner gear rotors in said predetermined direction, one of said pressure chambers including a minimum volume pressure chamber having a minimum gap portion between the teeth of said outer and inner gear rotors at a minimum gap position of said inner and outer gear rotors, wherein said intake opening starts to be opened in the vicinity of the minimum gap portion between the teeth of said outer and inner rotors so as to communicate with the minimum volume pressure chamber at the minimum gap portion thereby preventing closing of pressure in the chambers which have passed the outlet opening, and wherein said intake opening is opened at a position closer to said outlet opening than the minimum gap position.

2. The trochoid pump as set forth in claim 1, wherein said intake opening starts from a position advanced to a small degree in the rotating direction of said outer and inner rotors from said minimum gap position.

3. The trochoid pump as set forth in claim 1, wherein said intake opening starts to be opened at a position within a rotary angle of 4 degrees from said minimum gap position in the rotating direction.

4. A trochoid pump comprising, an outer gear rotor having a first predetermined number of teeth and an inner gear rotor having a second predetermined number of teeth different in number from the first predetermined number of teeth, the inner gear rotor teeth being in contact with the outer gear rotor teeth, such that pressure chambers are defined by adjoining teeth of said outer and inner gear rotors, said pressure chambers having corresponding volumes that gradually increase and gradually decrease respective predetermined amounts in accordance with rotations of said outer and inner gear rotors in a predetermined direction, an intake opening communicating with selected ones of said pressure chambers having volumes that gradually increase during rotation of said outer and inner gear rotors in said predetermined direction, and an outlet opening communicating with a second selected amount of said pressure chambers having corresponding volumes that gradually decrease during rotation of said outer and inner gear rotors in said predetermined direction, one of said pressure chambers including a minimum volume pressure chamber having a minimum gap portion between the teeth of said outer and inner gear rotors at a minimum gap position of said inner and outer gear rotors, wherein said intake opening starts to be opened in the vicinity of the minimum gap portion between the teeth of said outer and inner rotors so as to communicate with the minimum volume pressure chamber at the minimum gap portion thereby preventing closing of pressure in the chambers which have passed the outlet opening, and wherein said intake opening starts to be opened at a position within a rotary angle of 4° from said minimum gap position in the counter-rotational direction of said outer and inner rotors.

5. A trochoid pump comprising, an outer gear rotor having a first predetermined number of teeth and an inner gear rotor having a second predetermined number of teeth different in number from the first predetermined number of teeth, the inner gear rotor teeth being in contact with the outer gear rotor teeth, such that pressure chambers are defined by adjoining teeth of said outer and inner gear rotors, said pressure chambers having corresponding volumes that gradually increase and gradually decrease respective predetermined amounts in accordance with rotations of said outer and inner gear rotors in a predetermined direction, an intake opening communicating with selected ones of said pressure chambers having volumes that gradually increase during rotation of said outer and inner gear rotors in said predetermined direction, and an outlet opening communicating with selected others of said pressure chambers having volumes that gradually decrease during rotation of said outer and inner gear rotors in said predetermined direction, one of said pressure chambers including a minimum volume pressure chamber having a minimum gap portion between the teeth of said outer and inner gear rotors at a minimum gap position of said inner and outer gear rotors, and wherein said intake opening starts to be opened at the minimum gap portion between the teeth of said outer and inner rotors so as to communicate with the minimum volume pressure chamber at the minimum gap portion thereby preventing closing of pressure in the chambers which have passed the outlet opening.

* * * * *